US006663424B1

(12) United States Patent
Wyse et al.

(10) Patent No.: US 6,663,424 B1
(45) Date of Patent: Dec. 16, 2003

(54) ULTRA WIDEBAND INTERCONNECT SOLUTION

(75) Inventors: Russell D. Wyse, Center Point, IA (US); William L. Cronbaugh, Center Point, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 10/158,411

(22) Filed: May 30, 2002

(51) Int. Cl.[7] ..... H01R 9/05

(52) U.S. Cl. ..... 439/581; 439/551; 439/79; 439/76.1; 439/63; 333/260

(58) Field of Search ..... 439/63, 581, 79, 439/76.1, 551; 333/260

(56) References Cited

U.S. PATENT DOCUMENTS 4,125,308 A * 11/1978 Schilling ..... 439/63
4,611,186 A * 9/1986 Ziegner ..... 333/246
4,669,805 A * 6/1987 Kosugi et al. ..... 439/581
5,133,676 A * 7/1992 Hutchison et al. ..... 439/581
5,170,142 A * 12/1992 Bier ..... 333/245
5,263,880 A * 11/1993 Schwarz et al. ..... 439/733.1
5,641,294 A * 6/1997 Beard ..... 439/247
5,823,791 A * 10/1998 Bellantoni et al. ..... 439/63
6,302,701 B1 * 10/2001 Miller et al. ..... 439/63

* cited by examiner

*Primary Examiner*—Tho D. Ta
(74) *Attorney, Agent, or Firm*—Nathan O. Jensen; Kyle Eppele

(57) ABSTRACT

An ultra wideband interconnect from an external cable to an electric circuit. The interconnect includes an external cable including an external cable pin that projects from the termination of the external cable, an internal circuit, a conductive media coupled to the external cable pin and the internal circuit, and a package wall positioned between the external cable and the internal circuit. The package wall includes a cavity extending between the external cable and the internal circuit, the cavity having a coaxial structure. Further, the pin extends into but not through the cavity. The conductive media is coupled to the external cable pin within the cavity.

20 Claims, 2 Drawing Sheets

ULTRA WIDEBAND INTERCONNECT SOLUTION

GOVERNMENT LICENSE

The U.S. Government has a paid-up license in this invention and the right in limited circumstances to require the patent owner to license others on reasonable terms as provided for by the terms of Grant No. DAAD19-01-9-0001 awarded by the United States Army: Material Command Acquisition.

BACKGROUND OF THE INVENTION

The present invention relates generally to the field of connections between an external source or load and an internal circuit. More particularly, the present invention relates to an interconnect for transferring an ultra wideband frequency signal between an external source or load and internal circuit components.

Coaxial cable is often used to transmit and receive data signals. Interconnects can be used to connect the coaxial cable to an internal circuit that can interpret and utilize the content of the data signal or can forward the data signal to other components. The internal circuit can additionally transmit information to a load through the interconnect. The interconnect's structure enables the data signal to travel from the coaxial cable through a housing to the internal circuit and from and internal circuit through the housing to an external load.

Heretofore, an interconnect included a pin emerging from the coaxial cable connector, and extending over an internal circuit trace on a circuit board. The coaxial cable connector is situated in an aperture through the housing containing the circuit board and is connected to the circuit board with a conductive media. The conventional interconnect provides a fixed, direct and continuous contact with the internal circuit trace. However, the conventional interconnect does not provide optimal signal performance, especially at higher frequencies.

For mmWave and higher frequencies, optimally transmitting an electrical signal to the inside of a package or housing can be difficult. Problems with current interconnect structures include high insertion loss, high VSWR, and large field discontinuities which can couple through cavities and promote instabilities in electrical circuits.

Therefore, there is a need for a simple and effective wideband, low loss, low VSWR interconnect structure for connecting an external source or load to an internal circuit. Further there is a need for a simple, easy to manufacture method to provide the interconnect structure. Yet further, there is a need for an interconnect for higher frequency signals which is low cost, efficient, and easy to manufacture.

SUMMARY OF THE INVENTION

One embodiment of the invention relates to an interconnect for an electric circuit. The interconnect can include an external cable including an external cable pin projecting from the termination of the external cable, an internal circuit housed inside a package having a wall, an aperture in the package wall housing a receptacle, a connector and a cavity, wherein the external cable pin passes through the receptacle to electrically couple the external cable pin to a first conductive pin of the connector, and a conductive media for electrically coupling a second conductive pin of the connector to the internal circuit.

Another embodiment of the invention relates to an ultra wideband interconnect for electrically coupling an external cable to an internal circuit. The ultra wideband interconnect includes a coaxial cavity in a package wall for receiving a conductive pin from a connector, and a conductive media for coupling the conductive pin from a connector to a circuit trace on an internal circuit. The conductive media can be positioned to couple with the conductive pin within the cavity.

Another embodiment of the invention relates to a method for providing an ultra-wideband interconnect between an external cable and an internal circuit. The method includes providing a internal circuit including a circuit trace for receiving a data transmission enclosed in a package having a wall, wherein the wall includes an aperture defining a cavity, providing connector including a conductive pin assembly for sending a data transmission electrically coupled to an external cable, wherein the connector is housed within the wall such that the conductive pin extends into the cavity, coupling a conductive media to the conductive pin within the cavity, and coupling the conductive media to the circuit trace so as to electrically couple the conductive pin to the circuit trace.

BRIEF DESCRIPTION OF THE DRAWINGS

The invention will become more fully understood from the following detailed description, taken in conjunction with the accompanying drawings, wherein like reference numerals refer to like parts, and in which.

DETAILED DESCRIPTION OF THE PREFERRED EMBODIMENTS

Figure 1:
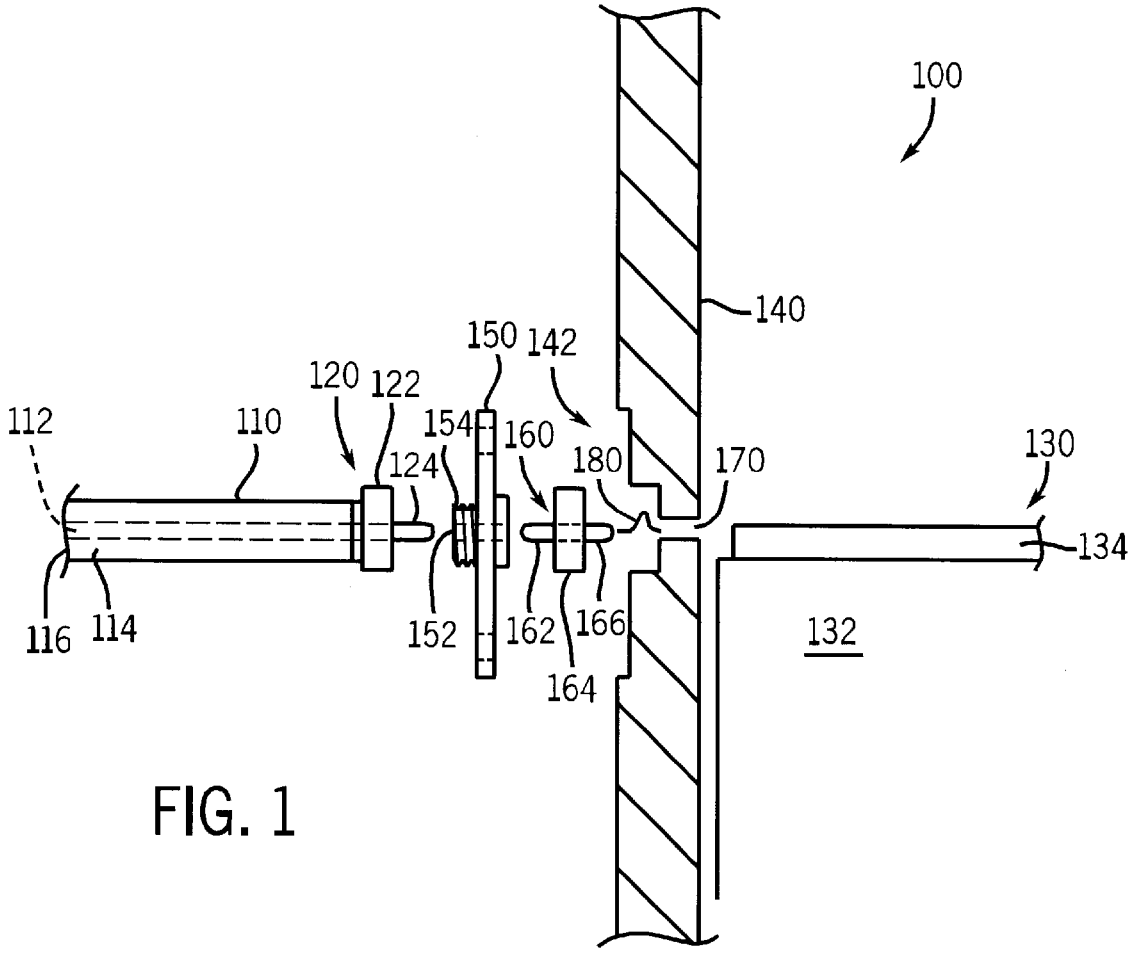
FIG. 1 is a exploded cross sectional view of an interconnection between an external cable and an internal circuit in accordance with an exemplary embodiment.

Referring to FIG. 1, an interconnect 100 is shown in accordance with an exemplary embodiment. Interconnect 100 provides a signal transition between a coaxial cable 110 and an internal circuit 130 through a wall 140. Interconnect 100 provides an electrical coupling between internal circuit 130 and coaxial cable 110.

Interconnect 100 can be used for both input and output functions. Interconnect 100 can be used to facilitate the transfer of information to or from internal 130 circuit to an external load or source. An external source can be any structure or device transmitting information. An external load can be any structure or device receiving information.

Coaxial Cable can be a standard coaxial cable as is well known in the art. Coaxial Cable 110 includes a signal line 112, an insulating material 114, an outer sheathing 116, and a connective housing 120. Connective housing 120 includes a female connector 122 surrounding a protruding conductive pin 124. Connective housing 120 is shown as having female connector 122, however it is understood that conductive housing 120 can be include any type of connector for securing coaxial cable 110 to wall 140. Coaxial cable 110 is manufactured in a fashion to promote propagation and integrity of a signal. Signal line 112 can formed from any medium capable of transmitting an ultra wideband signal. Signal line 112 is electrically coupled to conductive pin 124 so as to transmit a data signal from signal line 112 to conductive pin 124 or from conductive pin 124 to signal line 112. Coaxial cable 110 is traditionally utilized to transmit or send data to or from an external device to internal circuit 130. External devices can include an antenna, an oscilloscope, another circuit, or any other data source.

Internal circuit 130 can be any type of passive or active electrical device, structure, integrated circuit, etc. Internal circuit 130 can include a dielectric substrate 132 having a conductive pattern 134 formed on a surface. According to an exemplary embodiment, dielectric substrate 132 can be formed of aluminum hydride. According to an exemplary embodiment, conductive pattern 134 can be a copper strip-line circuit trace etched in accordance with standard lithographic techniques known in the art.

Wall 140 includes a aperture 142. Aperture 142 can extend through wall 140 defining an aperture between coaxial cable 110 and internal circuit 130. Wall 140 is positioned so as to abut or nearly abut internal circuit 130. Aperture 142 is defined so as to provide access to conductive pattern 134.

Aperature 142 houses a receptacle 150, a connector 160, and a cavity 170 to facilitate connection of coaxial cable 110 to internal circuit 130. Receptacle 150 can be any receptacle capable of receiving and securing a coaxial cable to a wall 140. According to an exemplary embodimnent, receptacle 150 can be a field replaceable two-hole flange mount jack receptacle. Receptacle 150 is positioned between coaxial cable 110 and connector 160.

According to an exemplary embodiment, receptacle 150 can be mounted to wall 140 by any standard mounting means. According to an exemplary embodiment, receptacle 150 is mounted using standard screws. Receptacle 150 includes a conductive pin hole 152 to receive and pass through conductive pin 124. Receptacle 150 further includes a male connector 154 to mate with female connector 122 to securely attach coaxial cable 110 to receptacle 150. Male connector 154 can be an OS-50 Jack.

Connector 160 is positioned within aperture 142 between receptacle 150 and internal circuit 130. Connector 160 includes a receptacle side conductive pin 162, a seal 164, and a internal circuit side conductive pin 166. Connector 160 can be any type of connector capable of receiving and passing a data signal. According to an exemplary embodiment, connector 160 can be a solder-in thermally matched hermetic seal.

According to an exemplary embodiment, conductive pin 124 can be electrically coupled to receptacle side conductive pin 162 to permit transfer of data to or from coaxial cable 110.

Connector 160 can also be positioned within aperture 142 such that internal circuit side conductive pin 166 is located within cavity 170 and terminates in close proximity to internal circuit 130. Connector 160 is also positioned such that internal circuit side conductive pin 166 terminates at a point near the end of cavity 170 proximate to internal circuit 130. According to an exemplary embodiment, internal circuit side conductive pin 166 terminates within 10 mm of the end of cavity 170.

Cavity 170 is a cavity within wall 140 having a characteristic impedance defined by the physical size of the cavity and the dielectric constant of the insulating material. According to an exemplary embodiment, as shown in FIG. 1, the insulating material can be air.

Conductive media 180 electrically couples internal circuit side conductive pin 166 to conductive pattern 134. Conductive media 180 can be any formable conductive media. According to an exemplary embodiment, conductive media 180 can be a singular or multiple gold ribbon or wire. Conductive media 180 can be coupled to internal circuit side conductive pin 166 within cavity 170 with a minimally short length of conductive media. Conductive media 180 does not maintain the characteristic impedance of the coax as the conductive media protrudes through wall 140. This has the effect of minimizing the discontinuity in the electrical signal path.

In operation, according to an exemplary embodiment, a signal can be placed on coaxial cable 110 for transmission into and out of internal circuit 130. The structure of interconnect 100, as defined above, can be used to maximize the field containment of the electrical signal. The field containment is maximized by providing a coaxial structure for the signal all the way through cavity 170 in wall 140 and transitioning to internal circuit 130 directly at the edge of wall 140 . This allows for the physical alignment of the coax field with internal circuit 130.

The transition between from internal circuit side conductive pin 166 to conductive media 180 occurs within the air coax of cavity 170, slightly before protruding beyond wall 140 into the cavity occupied by internal circuit 130. The physical alignment of the signal fields combined with the minimal distance of the interconnect where conductive media 180 is attached allows for superior performance. Superior performance can include an excellent return loss and an minimal insertion loss.

Figure 2A:
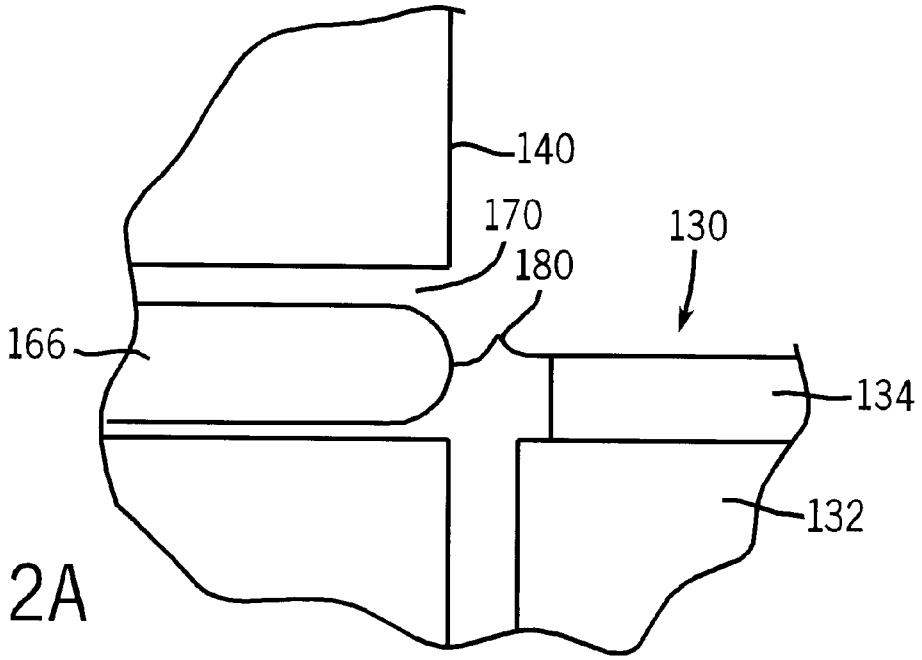
FIG. 2A is a cross sectional view of a conductive pin situated within a wall cavity terminating at the exit to the cavity and coupled to an internal circuit by a conductive media.

FIG. 2A is a cross sectional close up view of internal circuit side conductive pin 166 extending through the entire length of cavity 170. According to an exemplary embodiment, this embodiment minimizes the interconnect distance between internal circuit side conductive pin 166 and internal circuit 130 while still providing a transition from internal circuit side conductive pin 166 to conductive media 180 within cavity 170.

In FIG. 2A, internal circuit side conductive pin 166 is shown as rounded according to an exemplary embodiment. According to alternative embodiments, internal circuit side conductive pin 166 can be beveled or squared to maximize signal strength and integrity.

Figure 2B:
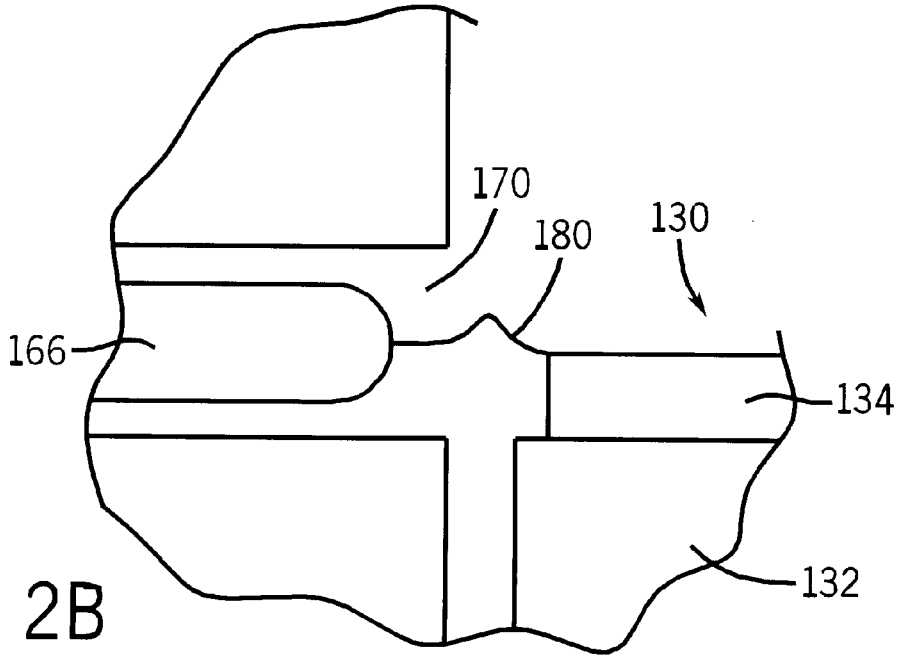
FIG. 2B is a cross sectional view of a conductive pin situated within a wall cavity terminating prior to exiting the cavity and coupled to an internal circuit by a conductive media.

FIG. 2B is a cross sectional close up view of internal circuit side conductive pin 166 extending a distance short of the entire length of cavity 170. According to an exemplary embodiment, this embodiment provides a transition from internal circuit side conductive pin 166 to conductive media 180 within cavity 170, but not at the exact edge of cavity 170. FIG. 2B illustrates that placement of internal circuit side conductive pin 166 along the entire length of cavity 170 is not required to provide the advantages of interconnect 100.

Figure 3:
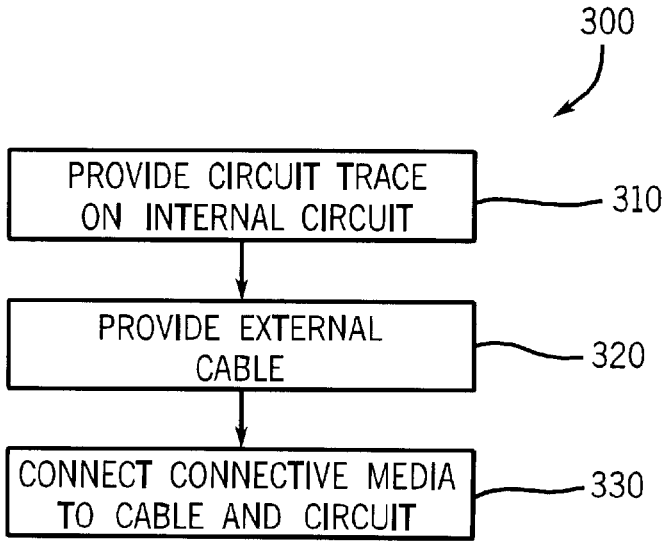
FIG. 3 is a flow diagram illustrating the steps for providing an ultra wideband interconnect.

FIG. 3 is a flow diagram 300 illustrating the steps in creating an ultra wideband interconnect according to an exemplary embodiment. Flow diagram 300 includes exemplary steps performed in the manufacture of an ultra wideband interconnect solution according to an exemplary embodiment.

In a step 310, a circuit trace is provided on a dielectric surface of an internal circuit to receive a data transmission from an external cable. The internal circuit is further enclosed inside a package having a wall. The internal circuit can be position proximate to the wall. The wall includes an aperture extending from external to the package to the inside of the package. The aperture further defines a cavity. The cavity is a coaxial space defining an air coax within the cavity. According to alternative embodiments, the cavity can be backfilled with any other type of dielectric media. The cavity can be positioned proximate to the internal circuit so as to provide access for an electrical coupling with the internal circuit. The circuit trace can be formed using lithographic etching techniques that are well known in the art.

In a step 320 an external cable is provided having a conductive pin . The external cable can carry a data transmission signal for transfer to the internal circuit. The external cable also includes a coupling assembly for coupling the external cable to a receptacle. The receptacle can be coupled to a connector. The receptacle and connector can be housed within the an aperture in the wall of the package containing the internal circuit. The receptacle, which is housed within the aperture defined in the wall, can be positioned such that the conductive pin associated with the connector is position entirely within the cavity.

In a step 330, a conductive media can be provided between the conductive pin associated with the connector and the circuit trace of the internal circuit. The conductive media can be coupled to the conductive pin associated with the connector within the cavity defined by the aperture in the wall of the package. The conductive media electrically couples the conductive pin associated with the connector to the circuit trace to allow transmission of a data signal.

While the exemplary embodiments illustrated in the FIGURES. and described above are presently preferred, it should be understood that these embodiments are offered by way of example only. For example, alternative embodiments may be suitable for use, wherein the internal circuit includes a die, or a transmission line other than a coaxial cable is used. Additionally, an air coax is described, but an alternative dielectric substrate can be backfilled into the cavity defined by the aperture in the cavity wall. Accordingly, the present invention is not limited to a particular embodiment, but extends to various modifications that nevertheless fall within the scope of the appended claims.

What is claimed is:

1. An interconnect for an electric circuit, comprising:

an external cable including an external cable pin projecting from the termination of the external cable;

an internal circuit housed inside a package having a wall;

an aperture in the package wall, the aperture housing a receptacle, a connector and a cavity, wherein the external cable pin passes through the receptacle to electrically couple the external cable pin to a first conductive pin of the connector; and a conductive media for electrically coupling a second conductive pin of the connector to the internal circuit, the conductive media positioned to couple with the second conductive pin within he cavity.

2. The interconnect of claim 1, wherein the second conductive pin of the connector extends the length of the cavity in the package wall.

3. The interconnect of claim 1, wherein the conductive media is gold wire.

4. The interconnect of claim 1, wherein the external cable is coupled to the package wall so as to anchor the external cable and electrically couple the external cable pin to the first conductive pin of the connector.

5. The interconnect of claim 1, wherein the connector is anchored within the aperture such that the second conductive pin of the connector is housed within cavity defined by the package wall.

6. The interconnect of claim 1, wherein the internal circuit includes a circuit trace.

7. The interconnect of claim 6, wherein the cavity is formed to be coaxial and define an air coax.

8. The interconnect of claim 7, wherein the second conductive pin of the connector is situated within the center of the air coax.

9. An ultra wideband interconnect for electrically coupling an external cable to an internal circuit, comprising:

a coaxial cavity in a package wall for receiving a conductive pin from a connector, and a conductive media for coupling the conductive pin from a connector to a circuit trace on an internal circuit, the conductive media being positioned to couple with the conductive pin within the cavity.

10. The ultra wideband interconnect of claim 9, wherein the coaxial cavity approximates the length of the conductive pin such that the conductive pin will extend into and along the length of the coaxial cavity, but not through the coaxial cavity.

11. The ultra wideband interconnect of claim 9, wherein the conductive media is gold ribbon.

12. The ultra wideband interconnect of claim 9, wherein the internal circuit includes a circuit trace.

13. The ultra wideband interconnect of claim 9, wherein the cavity defines an air coax.

14. The ultra wideband interconnect of claim 13, wherein coaxial cavity receives the conductive pin such that the conductive pin is positioned within the center of the air coax.

15. A method for providing an ultra-wideband interconnect between an external cable and an internal circuit, comprising:

providing an internal circuit including a circuit trace for receiving a data transmission enclosed in a package having a wall, wherein the wall includes an aperture defining a cavity;

providing a connector including a conductive pin assembly for sending a data transmission electrically coupled to an external cable, wherein the connector is housed within the wall such that the conductive pin extends into the cavity;

coupling a conductive media to the conductive pin within the cavity; and coupling the conductive media to the circuit face so as to electrically couple the conductive pin to the circuit trace.

16. The method of claim 15, wherein the conductive media is gold wire.

17. The method of claim 15, wherein the internal circuit is positioned proximate to the package wall.

18. The method of claim 15, wherein the conductive media is a gold ribbon.

19. The method of claim 15 wherein the cavity has a coaxial structure defining an air coax field.

20. The method of claim 19, wherein the conductive pin is positioned within the center of the air coax field.

* * * * *